US010321736B2

(12) United States Patent
Mokos

(10) Patent No.: US 10,321,736 B2
(45) Date of Patent: Jun. 18, 2019

(54) SHOE HAVING SOLE WITH TRANSVERSE GROOVES AND TREAD MEMBERS

(71) Applicant: Cole Haan LLC, New York, NY (US)

(72) Inventor: Jeffrey Mokos, Greenland, NH (US)

(73) Assignee: COLE HAAN LLC, New York, NY (US)

( * ) Notice: Subject to any disclaimer, the term of this patent is extended or adjusted under 35 U.S.C. 154(b) by 159 days.

(21) Appl. No.: 15/210,954

(22) Filed: Jul. 15, 2016

(65) Prior Publication Data

US 2018/0014606 A1 Jan. 18, 2018

(51) Int. Cl.

| | |
|---|---|
| ***A43B 13/22*** | (2006.01) |
| ***A43B 13/14*** | (2006.01) |
| ***A43B 13/04*** | (2006.01) |

(52) U.S. Cl.

CPC ..... *A43B 13/223* (2013.01); *A43B 13/04* (2013.01); *A43B 13/141* (2013.01)

(58) Field of Classification Search

CPC ..... A43B 13/123; A43B 13/22; A43B 13/04; A43B 13/141

See application file for complete search history.

(56) References Cited

U.S. PATENT DOCUMENTS

D213,898 S * 4/1969 Tousley ..... 62/457.6
3,824,716 A * 7/1974 Di Paolo ..... A43B 13/223 36/32 R
4,309,831 A * 1/1982 Pritt ..... A43B 7/06 36/3 B
5,394,624 A * 3/1995 Siepser ..... A43B 3/163 36/84
8,186,079 B2 * 5/2012 Carboy ..... A43B 13/223 36/102
9,629,415 B2 * 4/2017 Cortez ..... A43B 13/181
9,930,929 B2 * 4/2018 Cooper ..... A43B 13/187
2005/0022420 A1 * 2/2005 Thomas ..... A43B 1/009 36/8.1
2006/0086002 A1 * 4/2006 Vickers ..... A43B 3/16 36/7.1 R
2008/0201992 A1 * 8/2008 Avar ..... A43B 1/0009 36/25 R
2013/0042501 A1 * 2/2013 Velazquez ..... A43B 3/163 36/7.1 R
2013/0047474 A1 * 2/2013 Healy ..... A43B 13/122 36/30 R
2013/0118036 A1 * 5/2013 Gibson ..... A43B 1/0009 36/103
2014/0026438 A1 * 1/2014 Cortez ..... A43B 13/181 36/28
2014/0041261 A1 * 2/2014 Walker ..... A43B 3/0057 36/25 R

* cited by examiner

*Primary Examiner* — Jila M Mohandesi
(74) *Attorney, Agent, or Firm* — Thompson Coburn LLP

(57) ABSTRACT

A shoe includes an upper and a sole secured to the upper. The sole includes transversely extending tread members and transversely extending grooves. The width of a tread member in a midfoot region is greater than the width of a tread member in a heel region and greater than the width of a tread member in a metatarsal region. The width of a groove in a ball region is greater than a width of a groove in a toe region and greater than the width of a groove in the metatarsal region.

31 Claims, 4 Drawing Sheets

SHOE HAVING SOLE WITH TRANSVERSE GROOVES AND TREAD MEMBERS

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to shoes having soles with treads.

SUMMARY

One aspect of the invention is a shoe comprising a sole and an upper secured to the sole. The sole extends in a longitudinal direction from a sole heel end to a sole toe end and extends transversely from a sole lateral edge to a sole medial edge. The sole includes a heel region, a midfoot region, a metatarsal region, a ball region and a toe region. The heel region extends longitudinally forward from the sole heel end to the midfoot region. The midfoot region extends longitudinally forward from the heel region to the metatarsal region. The metatarsal region extends longitudinally forward from the midfoot region to the ball region. The ball region extends longitudinally forward from the metatarsal region to the toe region. The toe region extends longitudinally forward from the ball region to the sole toe end. The sole has a plurality of tread members and a plurality of grooves. Each of the plurality of tread members extends transversely between the sole lateral edge and the sole medial edge. Each of the plurality of grooves extends transversely between the sole lateral edge and the sole medial edge. Each of at least most of the plurality of grooves is between an adjacent pair of the plurality of tread members and has a groove width constituting a distance in the longitudinal direction from one of the tread members of the adjacent pair of tread members to the other of the tread members of the adjacent pair of tread members. Each of the plurality of grooves has a groove depth. Each of at least most of the plurality of tread members is between an adjacent pair of the plurality of grooves and has a tread width constituting a distance in the longitudinal direction from one of the grooves of the adjacent pair of grooves to the other of the grooves of the adjacent pair of grooves. The plurality of grooves comprises a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region. The plurality of tread members comprises a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region. The groove width of each of the plurality of heel grooves is greater than the groove width of each of the plurality of midfoot grooves. The groove width of each of the plurality of metatarsal grooves is greater than the groove width of each of the plurality of midfoot grooves. The groove width of each of the plurality of ball grooves is greater than the groove width of each of the plurality of metatarsal grooves. The groove width of each of the plurality of ball grooves is greater than the groove width of each of the plurality of toe grooves.

Another aspect of the invention is a shoe comprising a sole and an upper secured to the sole. The sole extends in a longitudinal direction from a sole heel end to a sole toe end and extends transversely from a sole lateral edge to a sole medial edge. The sole includes a heel region, a midfoot region, a metatarsal region, a ball region and a toe region. The heel region extends longitudinally forward from the sole heel end to the midfoot region. The midfoot region extends longitudinally forward from the heel region to the metatarsal region. The metatarsal region extends longitudinally forward from the midfoot region to the ball region. The ball region extends longitudinally forward from the metatarsal region to the toe region. The toe region extends longitudinally forward from the ball region to the sole toe end. The sole has a plurality of tread members and a plurality of grooves. Each of the plurality of tread members extends transversely between the sole lateral edge and the sole medial edge. Each of the plurality of grooves extends transversely between the sole lateral edge and the sole medial edge. Each of at least most of the plurality of grooves is between an adjacent pair of the plurality of tread members and has a groove width constituting a distance in the longitudinal direction from one of the tread members of the adjacent pair of tread members to the other of the tread members of the adjacent pair of tread members. Each of the plurality of grooves has a groove depth. Each of at least most of the plurality of tread members is between an adjacent pair of the plurality of grooves and has a tread width constituting a distance in the longitudinal direction from one of the grooves of the adjacent pair of grooves to the other of the grooves of the adjacent pair of grooves. The plurality of grooves comprises a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region. The plurality of tread members comprises a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region. The groove depth of each of the plurality of heel grooves is greater than the groove depth of each of the plurality of midfoot grooves. The groove depth of each of the plurality of metatarsal grooves is greater than the groove depth of each of the plurality of midfoot grooves. The groove depth of each of the plurality of ball grooves is greater than the groove depth of each of the plurality of metatarsal grooves. The groove depth of each of the plurality of ball grooves is greater than the groove depth of each of the plurality of toe grooves.

Another aspect of the invention is a shoe comprising a sole and an upper secured to the sole. The sole extends in a longitudinal direction from a sole heel end to a sole toe end and extends transversely from a sole lateral edge to a sole medial edge. The sole includes a heel region, a midfoot region, a metatarsal region, a ball region and a toe region. The heel region extends longitudinally forward from the sole heel end to the midfoot region. The midfoot region extends longitudinally forward from the heel region to the metatarsal region. The metatarsal region extends longitudinally forward from the midfoot region to the ball region. The ball region extends longitudinally forward from the metatarsal region to the toe region. The toe region extends longitudinally forward from the ball region to the sole toe end. The sole has a plurality of tread members and a plurality of grooves. Each of the plurality of tread members extends transversely between the sole lateral edge and the sole medial edge. Each of the plurality of grooves extends transversely between the sole lateral edge and the sole medial edge. Each of at least most of the plurality of grooves is between an adjacent pair of the plurality of tread members and has a groove width constituting a distance in the longitudinal direction from one of the tread members of the adjacent pair of tread members to the other of the tread members of the adjacent pair of tread members. Each of the plurality of grooves has a groove depth. Each of at least most of the plurality of tread members is between an adjacent pair of the plurality of grooves and has a tread width constituting a distance in the longitudinal direction from one of the grooves of the adjacent pair of grooves to the other of the grooves of the adjacent pair of grooves. The plurality of grooves comprises a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region. The plurality of tread members comprises a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region. The tread width of each of the plurality of heel tread members is less than the tread width of each of the plurality of midfoot tread members. The tread width of each of the plurality of metatarsal tread members is less than the tread width of each of the plurality of midfoot tread members. The tread width of each of the plurality of ball tread members is less than the tread width of each of the plurality of metatarsal tread members. The tread width of each of the plurality of ball tread members is less than the tread width of each of the plurality of toe tread members.

Another aspect of the invention is a shoe comprising a sole and an upper secured to the sole. The sole extends in a longitudinal direction from a sole heel end to a sole toe end and extends transversely from a sole lateral edge to a sole medial edge. The sole includes a heel region, a midfoot region, a metatarsal region, a ball region and a toe region. The heel region extends longitudinally forward from the sole heel end to the midfoot region. The midfoot region extends longitudinally forward from the heel region to the metatarsal region. The metatarsal region extends longitudinally forward from the midfoot region to the ball region. The ball region extends longitudinally forward from the metatarsal region to the toe region. The toe region extends longitudinally forward from the ball region to the sole toe end. The sole has a plurality of tread members and a plurality of grooves. Each of the plurality of tread members extends transversely between the sole lateral edge and the sole medial edge. Each of the plurality of grooves extends transversely between the sole lateral edge and the sole medial edge. Each of the plurality of grooves includes a plurality of upwardly projecting recesses. Each of the upwardly projecting recesses has a recess depth. Each of at least most of the plurality of grooves is between an adjacent pair of the plurality of tread members and has a groove width constituting a distance in the longitudinal direction from one of the tread members of the adjacent pair of tread members to the other of the tread members of the adjacent pair of tread members. Each of the plurality of grooves has a groove depth. Each of at least most of the plurality of tread members is between an adjacent pair of the plurality of grooves and has a tread width constituting a distance in the longitudinal direction from one of the grooves of the adjacent pair of grooves to the other of the grooves of the adjacent pair of grooves. The plurality of grooves comprises a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region. The plurality of tread members comprises a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region. The recess depth of each of the plurality of recesses in each of the plurality of heel grooves is greater than the recess depth of each of the plurality of recesses in each of the plurality of midfoot grooves. The recess depth of each of the plurality of recesses in each of the plurality of metatarsal grooves is greater than the recess depth of each of the plurality of recesses in each of the plurality of midfoot grooves. The recess depth of each of the plurality of recesses in each of the plurality of ball grooves is greater than the recess depth of each of the plurality of recesses in each of the plurality of metatarsal grooves. The recess depth of each of the plurality of recesses in each of the plurality of ball grooves is greater than the recess depth of each of the plurality of recesses in each of the plurality of toe grooves.

Another aspect of the invention is a shoe comprising a sole and an upper secured to the sole. The sole extends in a longitudinal direction from a sole heel end to a sole toe end and extends transversely from a sole lateral edge to a sole medial edge. The sole includes a heel region, a midfoot region, a metatarsal region, a ball region and a toe region. The heel region extends longitudinally forward from the sole heel end to the midfoot region. The midfoot region extends longitudinally forward from the heel region to the metatarsal region. The metatarsal region extends longitudinally forward from the midfoot region to the ball region. The ball region extends longitudinally forward from the metatarsal region to the toe region. The toe region extends longitudinally forward from the ball region to the sole toe end. The sole has a plurality of tread members and a plurality of grooves. Each of the plurality of tread members extends transversely between the sole lateral edge and the sole medial edge. Each of the plurality of grooves extends transversely between the sole lateral edge and the sole medial edge. Each of the plurality of grooves includes a plurality of upwardly projecting recesses. Each of the upwardly projecting recesses has a recess depth. Each of at least most of the plurality of grooves is between an adjacent pair of the plurality of tread members and has a groove width constituting a distance in the longitudinal direction from one of the tread members of the adjacent pair of tread members to the other of the tread members of the adjacent pair of tread members. Each of the plurality of grooves has a groove depth. Each of at least most of the plurality of tread members is between an adjacent pair of the plurality of grooves and has a tread width constituting a distance in the longitudinal direction from one of the grooves of the adjacent pair of grooves to the other of the grooves of the adjacent pair of grooves. The plurality of grooves comprises a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region. The plurality of tread members comprises a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region. Each of the plurality of tread members extends transversely between the sole lateral edge and the sole medial edge in a zigzag pattern. Each of the plurality of grooves extends transversely between the sole lateral edge and the sole medial edge in a zigzag pattern.

Further features and advantages, as well as the operation, are described in detail below with reference to the accompanying drawings.

Figure 1:
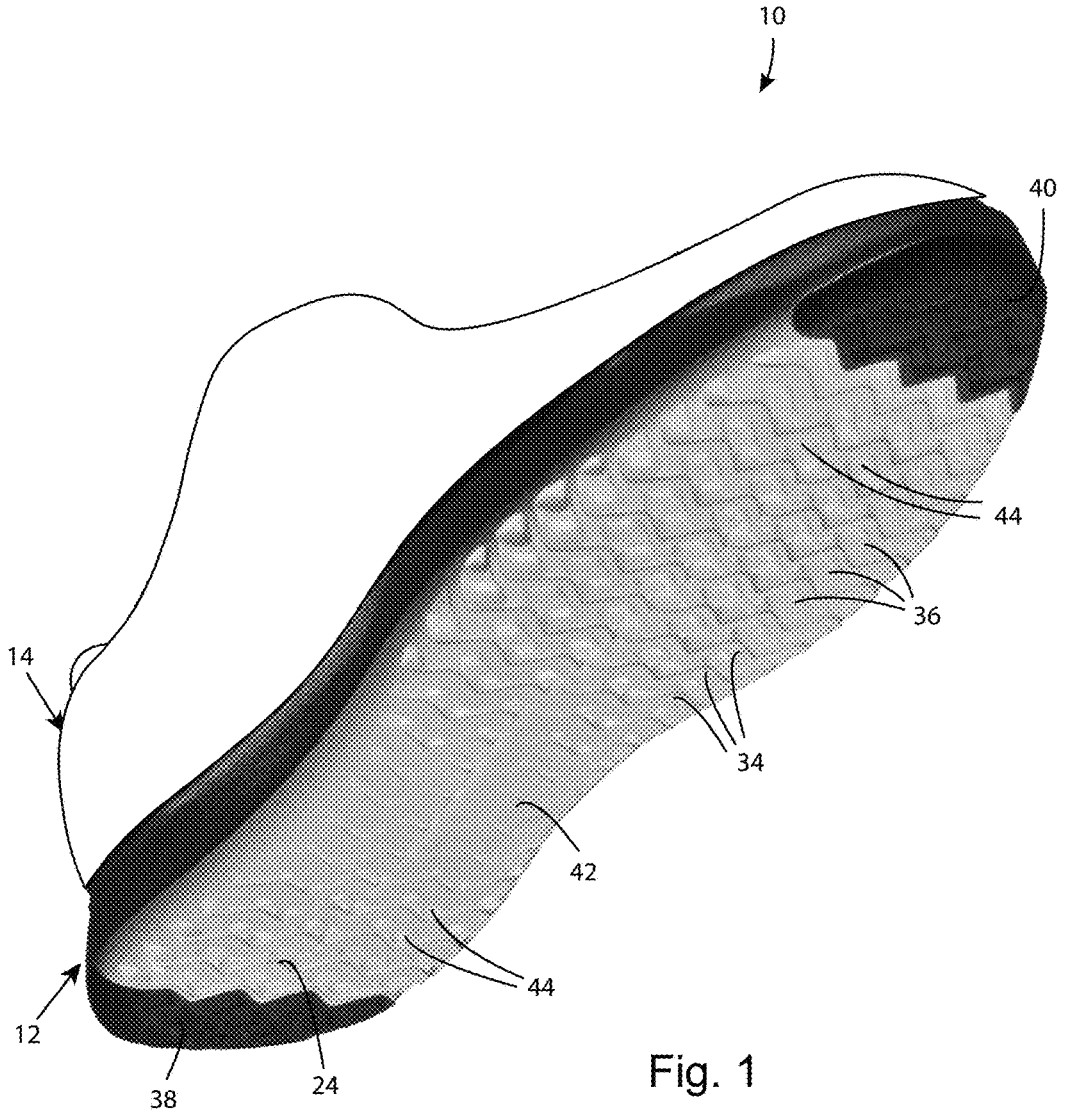
FIG. 1 is a bottom lateral perspective view of an exemplary embodiment of a shoe of the present disclosure.

Reference numerals in the written specification and in the figures indicate corresponding items.

DETAILED DESCRIPTION

Figure 2:
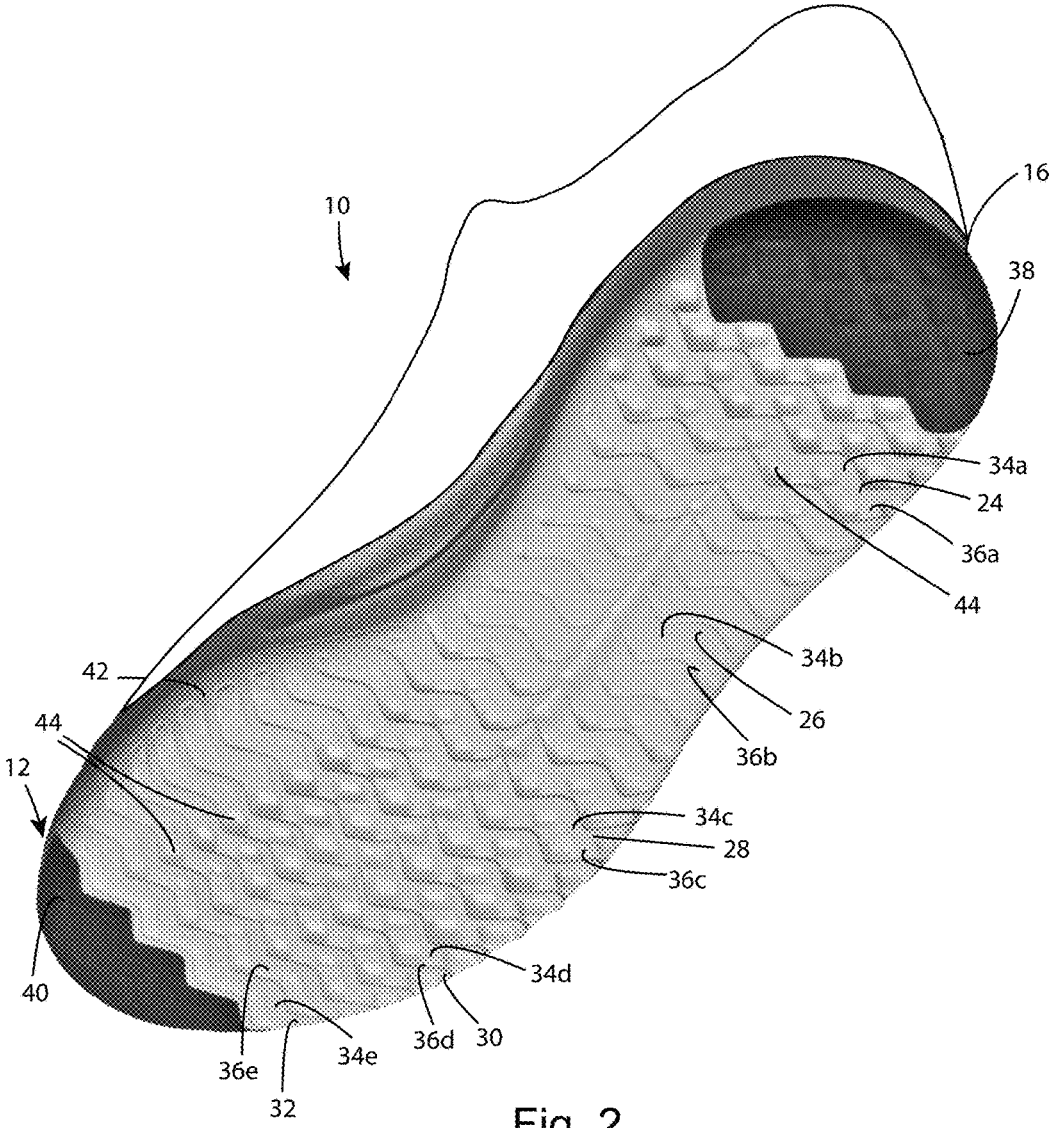
FIG. 2 is a bottom medial perspective view of the shoe of FIG. 1.
Figure 3:
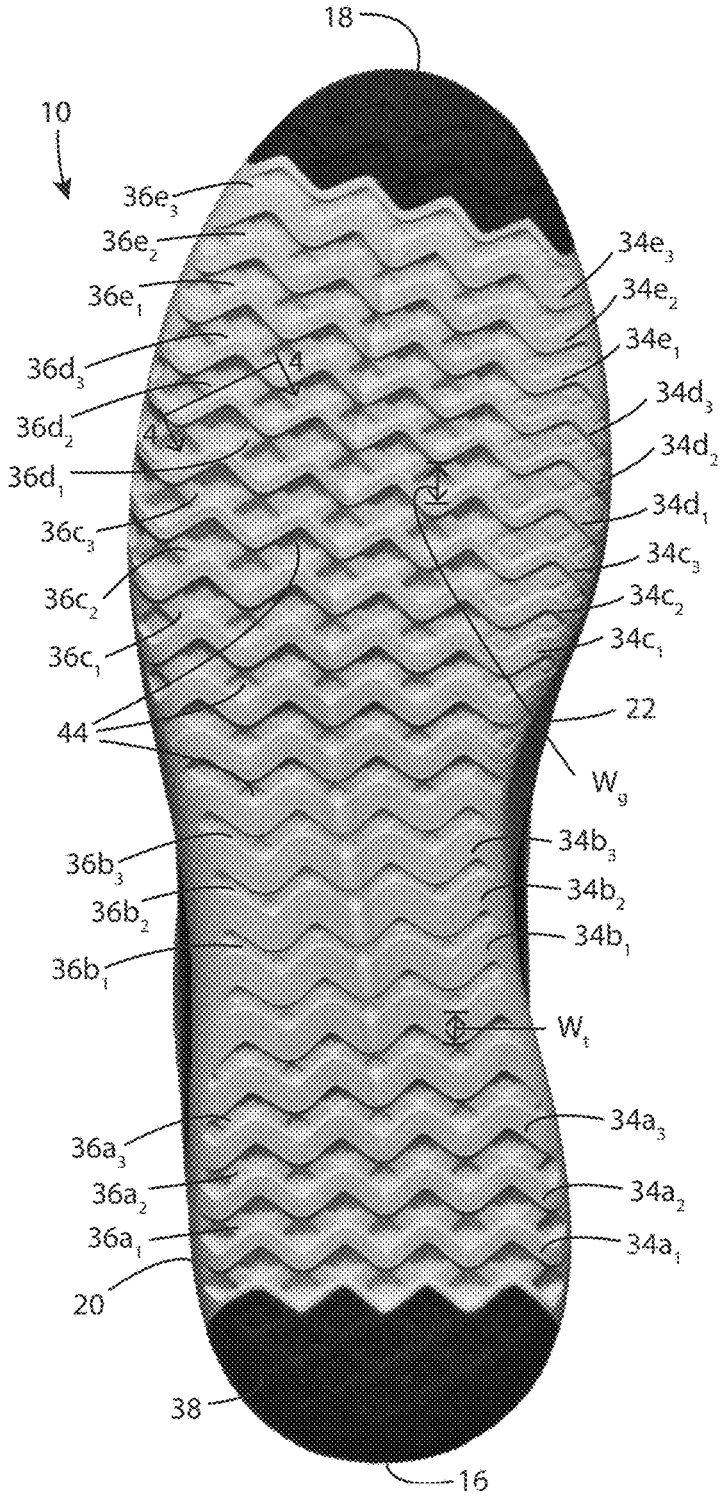
FIG. 3 is a bottom view of the shoe of FIG. 1.
Figure 4:
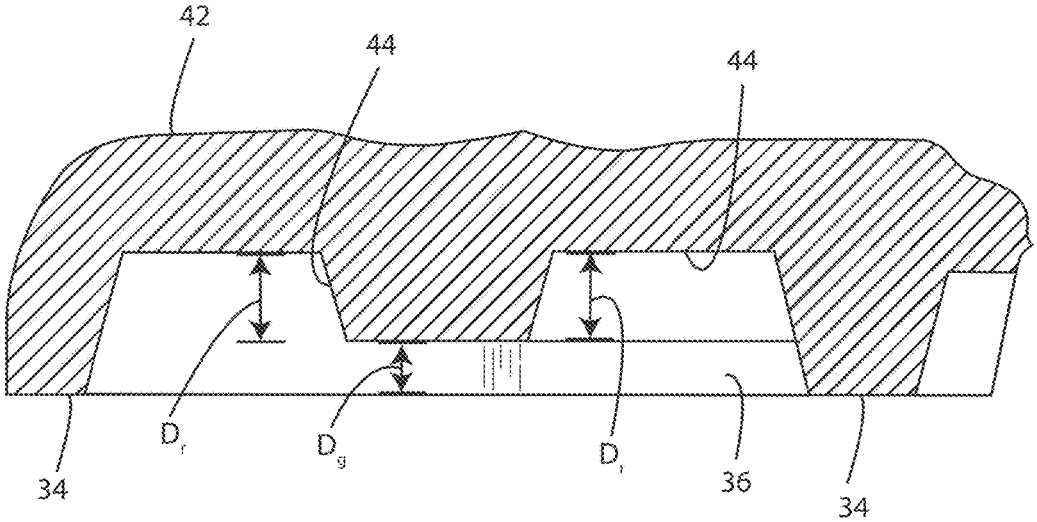
FIG. 4 is a cross-sectional view taken along the plane of line 4-4 of FIG. 3.

An embodiment of a shoe in accordance with the present invention is indicated by reference numeral 10 in FIGS. 1-4. The shoe 10 comprises a sole, generally indicated at 12, and an upper, generally indicated at 14. The sole 12 is secured to the upper 14. The sole 12 extends in a longitudinal direction from a sole heel end 16 to a sole toe end 18 and extends transversely from a sole lateral edge 20 to a sole medial edge 22. The sole 12 includes a heel region 24, a midfoot region 26, a metatarsal region 28, a ball region 30 and a toe region 32. The heel region 24 extends longitudinally forward from the sole heel end 16 to the midfoot region 26. As used herein, longitudinally forward means generally away from the sole heel end 16 and toward the sole toe end 18, and longitudinally rearward means generally away from the toe end and toward the heel end. The midfoot region 26 extends longitudinally forward from the heel region 24 to the metatarsal region 28. The metatarsal region 28 extends longitudinally forward from the midfoot region 26 to the ball region 30. The ball region 30 extends longitudinally forward from the metatarsal region 28 to the toe region 32. The toe region 32 extends longitudinally forward from the ball region 30 to the sole toe end 18.

The sole 12 has a plurality of tread members, indicated via the reference prefix number 34, and a plurality of grooves, indicated by the reference prefix number 36. As shown in the Figures (and as set forth more explicitly below), the reference prefix numbers 34 and 36 are combined with letter suffixes to distinguish tread members and grooves in a region of the sole 12 from tread members and grooves in other regions of the sole. Each of the plurality of tread members 34 extends transversely between the sole lateral edge 20 and the sole medial edge 22. Each of the plurality of grooves 36 extends transversely between the sole lateral edge 20 and the sole medial edge 22. In the embodiment of FIGS. 1-4, each of the plurality of tread members 34 and each of the plurality of grooves 36 also extend transversely from adjacent the sole lateral edge 20 to adjacent the sole medial edge 22. In an alternative embodiment, each of the plurality of tread members and each of the plurality of grooves extend transversely from the sole lateral edge to the sole medial edge. In the embodiment of FIGS. 1-4, each of the plurality of tread members 34 extends transversely between the sole lateral edge 20 and the sole medial edge 22 in a zigzag pattern, and each of the plurality of grooves 36 extends transversely between the sole lateral edge and the sole medial edge in a zigzag pattern. Each of the plurality of grooves 36 has a groove depth $D_g$ (see FIG. 4). Each of the plurality of grooves 36 is between an adjacent pair of the plurality of tread members 34 and has a groove width $W_g$ constituting a distance in the longitudinal direction from one of the tread members 34 of the adjacent pair of tread members to the other of the tread members of the adjacent pair of tread members. Each of the plurality of tread members 34 is between an adjacent pair of the plurality of grooves 36 and has a tread width $W_t$ constituting a distance in the longitudinal direction from one of the grooves 36 of the adjacent pair of grooves to the other of the grooves of the adjacent pair of grooves. In the embodiment of FIGS. 1-4, the sole 12 comprises a rubber heel member 38 at the sole heel end 16, a rubber toe member 40 at the sole toe end 18, and a closed-cell foam member 42 extending from the rubber heel member to the rubber toe member. The closed-cell foam member 42 is of any suitable, light-weight closed-cell foam, such as injection EVA. Each of the plurality of tread members 34 is in the closed-cell foam member 42. Each of the plurality of grooves 36 is in the closed-cell foam member 42.

The plurality of grooves 36 comprises a plurality of heel grooves **36*a* in the sole heel region 24, a plurality of midfoot grooves 36*b* in the sole midfoot region 26, a plurality of metatarsal grooves 36*c* in the sole metatarsal region 28, a plurality of ball grooves 36*d* in the sole ball region 30, and a plurality of toe grooves 36*e* in the sole toe region 32. The plurality of tread members 34 comprises a plurality of heel tread members 34*a* in the sole heel region 24, a plurality of midfoot tread members 34*b* in the sole midfoot region 26, a plurality of metatarsal tread members 34*c* in the sole metatarsal region 28, a plurality of ball tread members 34*d* in the sole ball region 30, and a plurality of toe tread members 34*e* in the sole toe region 32**.

The groove width $W_g$ of each of the plurality of heel grooves **36*a* is greater than the groove width of each of the plurality of midfoot grooves 36*b*. The groove width $W_g$ of each of the plurality of metatarsal grooves 36*c* is greater than the groove width of each of the plurality of midfoot grooves 36*b*. The groove width $W_g$ of each of the plurality of ball grooves 36*d* is greater than the groove width $W_g$ of each of the plurality of metatarsal grooves 36*c*. The groove width $W_g$ of each of the plurality of ball grooves 36*d* is greater than the groove width of each of the plurality of toe grooves 36*e***.

The groove depth $D_g$ of each of the plurality of heel grooves **36*a* is greater than the groove depth of each of the plurality of midfoot grooves 36*b*. The groove depth $D_g$ of each of the plurality of metatarsal grooves 36*c*** is greater than the groove depth of each of the plurality of midfoot grooves

36*b*. The groove depth $D_g$ of each of the plurality of ball grooves 36*d* is greater than the groove depth $D_g$ of each of the plurality of metatarsal grooves 36*c*. The groove depth $D_g$ of each of the plurality of ball grooves 36*d* is greater than the groove depth of each of the plurality of toe grooves 36*e*.

The tread width $W_t$ of each of the plurality of heel tread members 34*a* is less than the tread width of each of the plurality of midfoot tread members 34*b*. The tread width $W_t$ of each of the plurality of metatarsal tread members 34*c* is less than the tread width of each of the plurality of midfoot tread members 34*b*. The tread width $W_t$ of each of the plurality of ball tread members 34*d* is less than the tread width of each of the plurality of metatarsal tread members 34*c*. The tread width $W_t$ of each of the plurality of ball tread members 34*d* is less than the tread width of each of the plurality of toe tread members 34*e*.

The plurality of heel grooves 36*a* comprises a first heel groove 36$a_1$, a second heel groove 36$a_2$, and a third heel groove 36$a_3$. The second heel groove 36$_{a2}$ is forward of the first heel groove 36$a_1$. The third heel groove 36$a_3$ is forward of the second heel groove 36$a_2$. The groove width $W_g$ of the first heel groove 36$a_1$ is greater than the groove width $W_g$ of the second heel groove 36$a_2$. The groove width $W_g$ of the second heel groove 36$a_2$ is greater than the groove width $W_g$ of the third heel groove 36$a_3$. The plurality of heel tread members 34*a* comprises a first heel tread member 34$a_1$, a second heel tread member 34$a_2$, and a third heel tread member 34$a_3$. The second heel tread member 34$a_2$ is forward of the first heel tread member 34$a_1$. The third heel tread member 34$a_3$ is forward of the second heel tread member 34$a_2$. The tread width $W_t$ of the first heel tread member 34$a_1$ is less than the tread width of the second heel tread member 34$a_2$. The tread width $W_t$ of the second heel tread member 34$a_2$ is less than the tread width of the third heel tread member 34$a_3$.

The plurality of toe grooves 36*e* comprises a first toe groove 36$e_1$, a second toe groove 36$e_2$, and a third toe groove 36$e_3$. The second toe groove 36$e_2$ is forward of the first toe groove 36$e_1$. The third toe groove 36$e_3$ is forward of the second toe groove 36$e_2$. The groove width $W_g$ of the first toe groove 36$e_1$ is greater than the groove width of the second toe groove 36$e_2$. The groove width $W_g$ of the second toe groove 36$e_2$ is greater than the groove width of the third toe groove 36$e_3$. The plurality of toe tread members 34*e* comprises a first toe tread member 34$e_1$, a second toe tread member 34$e_2$, and a third toe tread member 34$e_3$. The second toe tread member 34$e_2$ is forward of the first toe tread member 34$e_1$. The third toe tread member 34$e_3$ is forward of the second toe tread member 34$e_2$. The tread width $W_t$ of the first toe tread member 34$e_1$ is less than the tread width $W_t$ of the second toe tread member 34$e_2$. The tread width $W_t$ of the second toe tread member 34$e_2$ is less than the tread width of the third toe tread member 34$e_3$.

The plurality of metatarsal grooves 36*c* comprises a first metatarsal groove 36$c_1$, a second metatarsal groove 36$c_2$, and a third metatarsal groove 36$c_3$. The second metatarsal groove 36$c_2$ is forward of the first metatarsal groove 36$c_1$, and the third metatarsal groove 36$c_3$ is forward of the second metatarsal groove. The groove width $W_g$ of the first metatarsal groove 36$c_1$ is less than the groove width of the second metatarsal groove 36$c_2$, and the groove width of the second metatarsal groove is less than the groove width of the third metatarsal groove 36$c_3$. The plurality of metatarsal tread members 34*c* comprises a first metatarsal tread member 34$c_1$, a second metatarsal tread member 34$c_2$, and a third metatarsal tread member 34$c_3$. The second metatarsal tread member 34$c_2$ is forward of the first metatarsal tread member 34$c_1$, and the third metatarsal tread member 34$c_3$ is forward of the second metatarsal tread member 34$c_2$. The tread width $W_t$ of the first metatarsal tread member 34$c_1$ is greater than the tread width of the second metatarsal tread member 34$c_2$, and the tread width of the second metatarsal tread member is greater than the tread width of the third metatarsal tread member 34$c_3$.

The plurality of midfoot grooves 36*b* comprises a first midfoot groove 36$b_1$, a second midfoot groove 36$b_2$, and a third midfoot groove 36$b_3$. The second midfoot groove 36$b_2$ is forward of the first midfoot groove 36$b_1$, and the third midfoot groove 36$b_3$ is forward of the second midfoot groove. The groove width $W_g$ of each of the first midfoot groove 36$b_1$, the second midfoot groove 36$b_2$, and the third midfoot groove 36$b_3$ is less than the groove width of each of the first heel groove 36$a_1$, the second heel groove 36$a_2$, and the third heel groove 36$a_3$. The groove width of each of the first, second, and third midfoot grooves is less than the groove width of each of the first, second, and third metatarsal grooves. The plurality of midfoot tread members 34*b* comprises a first midfoot tread member 34$b_1$, a second midfoot tread member 34$b_2$, and a third midfoot tread member 34$b_3$. The second midfoot tread member 34$b_2$ is forward of the first midfoot tread member 34$b_1$, and the third midfoot tread member 34$b_3$ is forward of the second midfoot tread member. The tread width $W_t$ of each of the first, second, and third midfoot tread members 34$b_1$, 34$b_2$, 34$b_3$ is greater than the tread width of each of the first, second, and third heel tread members 34$a_1$, 34$a_2$, 34$a_3$, and the tread width of each of the first, second, and third midfoot tread members is greater than the tread width of each of the first, second, and third metatarsal tread members 34$c_1$, 34$c_2$, 34$c_3$.

The plurality of ball grooves 36*d* comprises a first ball groove 36$d_1$, a second ball groove 36$d_2$, and a third ball groove 36$d_3$. The second ball groove 36$d_2$ is forward of the first ball groove 36$d_1$, and the third ball groove 36$d_3$ is forward of the second ball groove. The groove width $W_g$ of each of the first, second, and third ball grooves 36$d_1$, 36$d_2$, 36$d_3$ is greater than the groove width of each of the first, second, and third toe grooves 36$e_1$, 36$e_2$, 36$e_3$, and the groove width of each of the first, second, and third ball grooves is greater than the groove width of each of the first, second, and third metatarsal grooves 36$c_1$, 36$c_2$, 36$c_3$. The plurality of ball tread members 34*d* comprises a first ball tread member 34$d_1$, a second ball tread member 34$d_2$, and a third ball tread member 34$d_3$. The second ball tread member 34$d_2$ is forward of the first ball tread member 34$d_1$, and the third ball tread member 34$d_3$ is forward of the second ball tread member. The tread width $W_t$ of each of the first, second, and third ball tread members 34$d_1$, 34$d_2$, 34$d_3$, is less than the tread width of each of the first, second, and third toe tread members 34$e_1$, 34$e_2$, 34$e_3$, and the tread width of each of the first, second, and third ball tread members is less than the tread width of each of the first, second, and third metatarsal tread members 34$c_1$, 34$c_2$, 34$c_3$.

The groove depth $D_g$ of the first heel groove 36$a_1$ is greater than the groove depth of the second heel groove, and the groove depth of the second heel groove is greater than the groove depth of the third heel groove 36$a_3$. The groove depth $D_g$ of the first toe groove 36$e_1$ is greater than the groove depth of the second toe groove 36$e_2$, and the groove depth of the second toe groove is greater than the groove depth of the third toe groove 36$e_3$. The groove depth $D_g$ of the first metatarsal groove 36$c_1$ is less than the groove depth of the second metatarsal groove 36$c_2$, and the groove depth of the second metatarsal groove 36$c_2$ is less than the groove depth of the third metatarsal groove 36$c_3$. The groove depth $D_g$ of each of the first, second, and third midfoot grooves 36$b_1$, 36$b_2$, 36$b_3$ is less than the groove depth of each of the first, second, and third heel grooves 36$a_1$, 36$a_2$, 36$a_3$. The groove depth $D_g$ of each of the first, second, and third midfoot grooves 36$b_1$, 36$b_2$, 36$b_3$ is less than the groove depth of each of the first, second, and third metatarsal grooves 36$c_1$, 36$c_2$, 36$c_3$. The groove depth $D_g$ of each of the first, second, and third ball grooves 36$d_1$, 36$d_2$, 36$d_3$ is greater than the groove depth of each of the first, second, and third toe grooves 36$e_1$, 36$e_2$, 36$e_3$. The groove depth $D_g$ of each of the first, second, and third ball grooves 36$d_1$, 36$d_2$, 36$d_3$ is greater than the groove depth of each of the first, second, and third metatarsal grooves 36$c_1$, 36$c_2$, 36$c_3$.

Each of the plurality of grooves 36 includes a plurality of upwardly projecting recesses 44. Each of the upwardly projecting recesses 44 has a recess depth $D_r$ (see FIG. 4). The recess depth $D_r$ of each of the plurality of recesses 44 in each of the plurality of heel grooves 36*a* is greater than the recess depth of each of the plurality of recesses in each of the plurality of midfoot grooves 36*b*. The recess depth $D_r$ of each of the plurality of recesses 44 in each of the plurality of metatarsal grooves 36*c* is greater than the recess depth of each of the plurality of recesses in each of the plurality of midfoot grooves 36*b*. The recess depth $D_r$ of each of the plurality of recesses in each of the plurality of ball grooves 36*d* is greater than the recess depth of each of the plurality of recesses in each of the plurality of metatarsal grooves 36*c*. The recess depth $D_r$ of each of the plurality of recesses 44 in each of the plurality of ball grooves 36*d* is greater than the recess depth of each of the plurality of recesses in each of the plurality of toe grooves 36*e*.

The recess depth $D_r$ of each of the plurality of recesses 44 in the first heel groove 36$a_1$ is greater than the recess depth of each of the plurality of recesses 44 in the second heel groove 36$a_2$, and the recess depth of each of the plurality of recesses in the second heel groove is greater than the recess depth of each of the plurality of recesses in the third heel groove 36$a_3$. The recess depth $D_r$ of each of the plurality of recesses in the first toe groove 36$e_1$ is greater than the recess depth of each of the plurality of recesses in the second toe groove 36$e_2$, and the recess depth of each of the plurality of recesses in the second toe groove 36$e_2$ is greater than the recess depth of each of the plurality of recesses in the third toe groove 36$e_3$.

The recess depth $D_r$ of each of the plurality of recesses in the first metatarsal groove 36$c_1$ is less than the recess depth of each of the plurality of recesses in the second metatarsal groove 36$c_2$, and the recess depth of each of the plurality of recesses in the second metatarsal groove 36$c_2$ is less than the recess depth of each of the plurality of recesses in the third metatarsal groove 36$c_3$.

The recess depth $D_r$ of each of the plurality of recesses in each of the first, second, and third midfoot grooves 36$b_1$, 36$b_2$, 36$b_3$ is less than the recess depth of each of the plurality of recesses in each of the first, second, and third heel grooves 36$a_1$, 36$a_2$, 36$a_3$, and the recess depth of each of the plurality of recesses in each of the first, second, and third midfoot grooves is less than the recess depth of each of the plurality of recesses in each of the first, second, and third metatarsal grooves 36$c_1$, 36$c_2$, 36$c_3$. The recess depth $D_r$ of each of the plurality of recesses 44 in each of the first, second, and third ball grooves 36$d_1$, 36$d_2$, 36$d_3$ is greater than the recess depth of each of the plurality of recesses in each of the first, second, and third toe grooves 36$e_1$, 36$e_2$, 36$e_3$, and the recess depth of each of the plurality of recesses in each of the first, second, and third ball grooves is greater than the recess depth of each of the plurality of recesses in each of the first, second, and third metatarsal grooves 36$c_1$, 36$c_2$, 36$c_3$.

The combination of features described herein provides a sole that is lightweight while providing greater flexibility in regions in which greater flexibility is desirable, and less flexibility in regions in which less flexibility is desirable.

In view of the foregoing, it should be appreciated that the invention has several advantages over the prior art.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Also, as used herein, the term "shoe" is synonymous with footwear. As such, shoe encompasses boots, sandals, oxfords, and other types of footwear. Moreover, use of identifiers such as first, second, and third should not be construed in a manner imposing any relative position or time sequence between limitations. Also, the term "plurality" when used in connection with an element should not be interpreted as referring to all such elements in the shoe. For example, the phrase "the recess depth $D_r$ of each of the plurality of recesses 44 in each of the plurality of ball grooves 36*d* is greater than the recess depth of each of the plurality of recesses in each of the plurality of toe grooves 36*e*" merely means the recess depth of each of two or more of the recesses in each of two or more of the ball grooves is greater than the recess depth of each of two or more of the recesses in each of two or more of the toe grooves.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A shoe comprising:

a sole; and an upper secured to the sole;

the sole extending in a longitudinal direction from a sole heel end to a sole toe end and extending transversely from a sole lateral edge to a sole medial edge, the sole including a heel region, a midfoot region, a metatarsal region, a ball region and a toe region, the heel region extending longitudinally forward from the sole heel end to the midfoot region, the midfoot region extending longitudinally forward from the heel region to the metatarsal region, the metatarsal region extending longitudinally forward from the midfoot region to the ball region, the ball region extending longitudinally forward from the metatarsal region to the toe region, and the toe region extending longitudinally forward from the ball region to the sole toe end, the sole having a plurality of tread members and a plurality of grooves, each of the plurality of tread members extending transversely between the sole lateral edge and the sole medial edge, each of the plurality of grooves extending transversely between the sole lateral edge and the sole medial edge, each of at least most of the plurality of grooves being between an adjacent pair of the plurality of tread members and having a groove width constituting a distance in the longitudinal direction from one of the tread members of the adjacent pair of tread members to the other of the tread members of the adjacent pair of tread members, each of the plurality of grooves having a groove depth, each of at least most of the plurality of tread members being between an adjacent pair of the plurality of grooves and having a tread width constituting a distance in the longitudinal direction from one of the grooves of the adjacent pair of grooves to the other of the grooves of the adjacent pair of grooves, the plurality of grooves comprising a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region, the plurality of tread members comprising a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region, the groove width of each of the plurality of heel grooves being greater than the groove width of each of the plurality of midfoot grooves, the groove width of each of the plurality of metatarsal grooves being greater than the groove width of each of the plurality of midfoot grooves, the groove width of each of the plurality of ball grooves being greater than the groove width of each of the plurality of metatarsal grooves, the groove width of each of the plurality of ball grooves being greater than the groove width of each of the plurality of toe grooves.

2. A shoe as set forth in claim 1 wherein:

the tread width of each of the plurality of heel tread members is less than the tread width of each of the plurality of midfoot tread members, the tread width of each of the plurality of metatarsal tread members is less than the tread width of each of the plurality of midfoot tread members, the tread width of each of the plurality of ball tread members is less than the tread width of each of the plurality of metatarsal tread members, the tread width of each of the plurality of ball tread members is less than the tread width of each of the plurality of toe tread members.

3. A shoe as set forth in claim 1 wherein:

the plurality of heel grooves comprises a first heel groove and a second heel groove, the second heel groove being forward of the first heel groove, the groove width of the first heel groove being greater than the groove width of the second heel groove the plurality of heel tread members comprises a first heel tread member and a second heel tread member, the second heel tread member being forward of the first heel tread member, the tread width of the first heel tread member being less than the tread width of the second heel tread member.

4. A shoe as set forth in claim 3 wherein:

the plurality of heel grooves further comprises a third heel groove, the third heel groove being forward of the second heel groove, the groove width of the second heel groove being greater than the groove width of the third heel groove, the plurality of heel tread members further comprises a third heel tread member, the third heel tread member being forward of the second heel tread member, the tread width of the second heel tread member being less than the tread width of the third heel tread member.

5. A shoe as set forth in claim 3 wherein:

the plurality of toe grooves comprises a first toe groove and a second toe groove, the second toe groove being forward of the first toe groove, the groove width of the first toe groove being greater than the groove width of the second toe groove, the plurality of toe tread members comprises a first toe tread member and a second toe tread member, the second toe tread member being forward of the first toe tread member, the tread width of the first toe tread member being less than the tread width of the second toe tread member.

6. A shoe as set forth in claim 5 wherein:

the plurality of toe grooves further comprises a third toe groove, the third toe groove being forward of the second toe groove, the groove width of the second toe groove being greater than the groove width of the third toe groove, the plurality of toe tread members further comprises a third toe tread member, the third toe tread member being forward of the second toe tread member, the tread width of the second toe tread member being less than the tread width of the third toe tread member.

7. A shoe as set forth in claim 5 wherein:

the plurality of metatarsal grooves comprises a first metatarsal groove and a second metatarsal groove, the second metatarsal groove being forward of the first metatarsal groove, the groove width of the first metatarsal groove being less than the groove width of the second metatarsal groove, the plurality of metatarsal tread members comprises a first metatarsal tread member and a second metatarsal tread member, the second metatarsal tread member being forward of the first metatarsal tread member, the tread width of the first metatarsal tread member being greater than the tread width of the second metatarsal tread member.

8. A shoe as set forth in claim 7 wherein:

the plurality of metatarsal grooves further comprises a third metatarsal groove, the third metatarsal groove being forward of the second metatarsal groove, the groove width of the second metatarsal groove being less than the groove width of the third metatarsal groove, the plurality of metatarsal tread members further comprises a third metatarsal tread member, the third metatarsal tread member being forward of the second metatarsal tread member, the tread width of the second metatarsal tread member being greater than the tread width of the third metatarsal tread member.

9. A shoe as set forth in claim 7 wherein:

the plurality of midfoot grooves comprises a first midfoot groove and a second midfoot groove, the second midfoot groove being forward of the first midfoot groove, the groove width of each of the first and second midfoot grooves being less than the groove width of each of the first and second heel grooves, the groove width of each of the first and second midfoot grooves being less than the groove width of each of the first and second metatarsal grooves, the plurality of midfoot tread members comprises a first midfoot tread member and a second midfoot tread member, the second midfoot tread member being forward of the first midfoot tread member, the tread width of each of the first and second midfoot tread members being greater than the tread width of each of the first and second heel tread members, the tread width of each of the first and second midfoot tread members being greater than the tread width of each of the first and second metatarsal tread members.

10. A shoe as set forth in claim 9 wherein:

the plurality of ball grooves comprises a first ball groove and a second ball groove, the second ball groove being forward of the first ball groove, the groove width of each of the first and second ball grooves being greater than the groove width of each of the first and second toe grooves, the groove width of each of the first and second ball grooves being greater than the groove width of each of the first and second metatarsal grooves, the plurality of ball tread members comprises a first ball tread member and a second ball tread member, the second ball tread member being forward of the first ball tread member, the tread width of each of the first and second ball tread members being less than the tread width of each of the first and second toe tread members, the tread width of each of the first and second ball tread members being less than the tread width of each of the first and second metatarsal tread members.

11. A shoe as set forth in claim 10 wherein:

the plurality of ball grooves further comprises a third ball groove, the third ball groove being forward of the second ball groove, the groove width of the third ball grooves being greater than the groove width of each of the first and second toe grooves, the groove width of the third ball grooves being greater than the groove width of each of the first and second metatarsal grooves, the plurality of ball tread members further comprises a third ball tread member, the third ball tread member being forward of the second ball tread member, the tread width of the third ball tread member being less than the tread width of each of the first and second toe tread members, the tread width of the third ball tread member being less than the tread width of each of the first and second metatarsal tread members.

12. A shoe as set forth in claim 10 wherein:

the groove depth of the first heel groove is greater than the groove depth of the second heel groove;

the groove depth of the first toe groove is greater than the groove depth of the second toe groove;

the groove depth of the first metatarsal groove is less than the groove depth of the second metatarsal groove;

the groove depth of each of the first and second midfoot grooves is less than the groove depth of each of the first and second heel grooves, the groove depth of each of the first and second midfoot grooves is less than the groove depth of each of the first and second metatarsal grooves;

the groove depth of each of the first and second ball grooves is greater than the groove depth of each of the first and second toe grooves, the groove depth of each of the first and second ball grooves is greater than the groove depth of each of the first and second metatarsal grooves.

13. A shoe as set forth in claim 12 wherein:

each of the plurality of grooves includes a plurality of upwardly projecting recesses, each of the upwardly projecting recesses having a recess depth, the recess depth of each of the plurality of recesses in the first heel groove being greater than the recess depth of each of the plurality of recesses in the second heel groove, the recess depth of each of the plurality of recesses in the first toe groove being greater than the recess depth of each of the plurality of recesses in the second toe groove, the recess depth of each of the plurality of recesses in the first metatarsal groove being less than the recess depth of each of the plurality of recesses in the second metatarsal groove, the recess depth of each of the plurality of recesses in each of the first and second midfoot grooves being less than the recess depth of each of the plurality of recesses in each of the first and second heel grooves, the recess depth of each of the plurality of recesses in each of the first and second midfoot grooves being less than the recess depth of each of the plurality of recesses in each of the first and second metatarsal grooves, the recess depth of each of the plurality of recesses in each of the first and second ball grooves being greater than the recess depth of each of the plurality of recesses in each of the first and second toe grooves, the recess depth of each of the plurality of recesses in each of the first and second ball grooves being greater than the recess depth of each of the plurality of recesses in each of the first and second metatarsal grooves.

14. A shoe as set forth in claim 1 wherein the plurality of heel grooves comprises a first heel groove, a second heel groove, and a third heel groove, the second heel groove being forward of the first heel groove, the third heel groove being forward of the second heel groove, the groove depth of the first heel groove being greater than the groove depth of the second heel groove, the groove depth of the second heel groove being greater than the groove depth of the third heel groove.

15. A shoe as set forth in claim 14 wherein the plurality of toe grooves comprises a first toe groove, a second toe groove, and a third toe groove, the second toe groove being forward of the first toe groove, the third toe groove being forward of the second toe groove, the groove depth of the first toe groove being greater than the groove depth of the second toe groove, the groove depth of the second toe groove being greater than the groove depth of the third toe groove.

16. A shoe as set forth in claim 15 wherein the plurality of metatarsal grooves comprises a first metatarsal groove, a second metatarsal groove, and a third metatarsal groove, the second metatarsal groove being forward of the first metatarsal groove, the third metatarsal groove being forward of the second metatarsal groove, the groove depth of the first metatarsal groove being less than the groove depth of the second metatarsal groove, the groove depth of the second metatarsal groove being less than the groove depth of the third metatarsal groove.

17. A shoe as set forth in claim 16 wherein the plurality of midfoot grooves comprises a first midfoot groove, a second midfoot groove, and a third midfoot groove, the second midfoot groove being forward of the first midfoot groove, the third midfoot groove being forward of the second midfoot groove, the groove depth of each of the first, second, and third midfoot grooves being less than the groove depth of each of the first, second, and third heel grooves, the groove depth of each of the first, second, and third midfoot grooves being less than the groove depth of each of the first, second, and third metatarsal grooves.

18. A shoe as set forth in claim 17 wherein the plurality of ball grooves comprises a first ball groove, a second ball groove, and a third ball groove, the second ball groove being forward of the first ball groove, the third ball groove being forward of the second ball groove, the groove depth of each of the first, second, and third ball grooves being greater than the groove depth of each of the first, second, and third toe grooves, the groove depth of each of the first, second, and third ball grooves being greater than the groove depth of each of the first, second, and third metatarsal grooves.

19. A shoe as set forth in claim 1 wherein each of the plurality of grooves includes a plurality of upwardly projecting recesses, each of the upwardly projecting recesses having a recess depth.

20. A shoe as set forth in claim 19 wherein the plurality of heel grooves comprises a first heel groove, a second heel groove, and a third heel groove, the second heel groove being forward of the first heel groove, the third heel groove being forward of the second heel groove, the recess depth of each of the plurality of recesses in the first heel groove being greater than the recess depth of each of the plurality of recesses in the second heel groove, the recess depth of each of the plurality of recesses in the second heel groove being greater than the recess depth of each of the plurality of recesses in the third heel groove.

21. A shoe as set forth in claim 20 wherein the plurality of toe grooves comprises a first toe groove, a second toe groove, and a third toe groove, the second toe groove being forward of the first toe groove, the third toe groove being forward of the second toe groove, the recess depth of each of the plurality of recesses in the first toe groove being greater than the recess depth of each of the plurality of recesses in the second toe groove, the recess depth of each of the plurality of recesses in the second toe groove being greater than the recess depth of each of the plurality of recesses in the third toe groove.

22. A shoe as set forth in claim 21 wherein the plurality of metatarsal grooves comprises a first metatarsal groove, a second metatarsal groove, and a third metatarsal groove, the second metatarsal groove being forward of the first metatarsal groove, the third metatarsal groove being forward of the second metatarsal groove, the recess depth of each of the plurality of recesses in the first metatarsal groove being less than the recess depth of each of the plurality of recesses in the second metatarsal groove, the recess depth of each of the plurality of recesses in the second metatarsal groove being less than the recess depth of each of the plurality of recesses in the third metatarsal groove.

23. A shoe as set forth in claim 22 wherein the plurality of midfoot grooves comprises a first midfoot groove, a second midfoot groove, and a third midfoot groove, the second midfoot groove being forward of the first midfoot groove, the third midfoot groove being forward of the second midfoot groove, the recess depth of each of the plurality of recesses in each of the first, second, and third midfoot grooves being less than the recess depth of each of the plurality of recesses in each of the first, second, and third heel grooves, the recess depth of each of the plurality of recesses in each of the first, second, and third midfoot grooves being less than the recess depth of each of the plurality of recesses in each of the first, second, and third metatarsal grooves.

24. A shoe as set forth in claim 23 wherein the plurality of ball grooves comprises a first ball groove, a second ball groove, and a third ball groove, the second ball groove being forward of the first ball groove, the third ball groove being forward of the second ball groove, the recess depth of each of the plurality of recesses in each of the first, second, and third ball grooves being greater than the recess depth of each of the plurality of recesses in each of the first, second, and third toe grooves, the recess depth of each of the plurality of recesses in each of the first, second, and third ball grooves being greater than the recess depth of each of the plurality of recesses in each of the first, second, and third metatarsal grooves.

25. A shoe as set forth in claim 1 wherein:

each of the plurality of tread members extends transversely between the sole lateral edge and the sole medial edge in a zigzag pattern;

each of the plurality of grooves extends transversely between the sole lateral edge and the sole medial edge in a zigzag pattern.

26. A shoe as set forth in claim 1 wherein the sole comprises a closed-cell foam member, each of the plurality of tread members being in the closed-cell foam member, each of the plurality of grooves being in the closed-cell foam member.

27. A shoe comprising:

a sole; and an upper secured to the sole;

the sole extending in a longitudinal direction from a sole heel end to a sole toe end and extending transversely from a sole lateral edge to a sole medial edge, the sole including a heel region, a midfoot region, a metatarsal region, a ball region and a toe region, the heel region extending longitudinally forward from the sole heel end to the midfoot region, the midfoot region extending longitudinally forward from the heel region to the metatarsal region, the metatarsal region extending longitudinally forward from the midfoot region to the ball region, the ball region extending longitudinally forward from the metatarsal region to the toe region, and the toe region extending longitudinally forward from the ball region to the sole toe end, the sole having a plurality of tread members and a plurality of grooves, each of the plurality of tread members extending transversely between the sole lateral edge and the sole medial edge, each of the plurality of grooves extending transversely between the sole lateral edge and the sole medial edge, each of at least most of the plurality of grooves being between an adjacent pair of the plurality of tread members and having a groove width constituting a distance in the longitudinal direction from one of the tread members of the adjacent pair of tread members to the other of the tread members of the adjacent pair of tread members, each of the plurality of grooves having a groove depth, each of at least most of the plurality of tread members being between an adjacent pair of the plurality of grooves and having a tread width constituting a distance in the longitudinal direction from one of the grooves of the adjacent pair of grooves to the other of the grooves of the adjacent pair of grooves, the plurality of grooves comprising a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region, the plurality of tread members comprising a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region, the groove depth of each of the plurality of heel grooves being greater than the groove depth of each of the plurality of midfoot grooves, the groove depth of each of the plurality of metatarsal grooves being greater than the groove depth of each of the plurality of midfoot grooves, the groove depth of each of the plurality of ball grooves being greater than the groove depth of each of the plurality of metatarsal grooves, the groove depth of each of the plurality of ball grooves being greater than the groove depth of each of the plurality of toe grooves.

28. A shoe comprising:

a sole; and an upper secured to the sole;

the sole extending in a longitudinal direction from a sole heel end to a sole toe end and extending transversely from a sole lateral edge to a sole medial edge, the sole including a heel region, a midfoot region, a metatarsal region, a ball region and a toe region, the heel region extending longitudinally forward from the sole heel end to the midfoot region, the midfoot region extending longitudinally forward from the heel region to the metatarsal region, the metatarsal region extending longitudinally forward from the midfoot region to the ball region, the ball region extending longitudinally forward from the metatarsal region to the toe region, and the toe region extending longitudinally forward from the ball region to the sole toe end, the sole having a plurality of tread members and a plurality of grooves, each of the plurality of tread members extending transversely between the sole lateral edge and the sole medial edge, each of the plurality of grooves extending transversely between the sole lateral edge and the sole medial edge, each of at least most of the plurality of grooves being between an adjacent pair of the plurality of tread members and having a groove width constituting a distance in the longitudinal direction from one of the tread members of the adjacent pair of tread members to the other of the tread members of the adjacent pair of tread members, each of the plurality of grooves having a groove depth, each of at least most of the plurality of tread members being between an adjacent pair of the plurality of grooves and having a tread width constituting a distance in the longitudinal direction from one of the grooves of the adjacent pair of grooves to the other of the grooves of the adjacent pair of grooves, the plurality of grooves comprising a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region, the plurality of tread members comprising a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region, the tread width of each of the plurality of heel tread members being less than the tread width of each of the plurality of midfoot tread members, the tread width of each of the plurality of metatarsal tread members being less than the tread width of each of the plurality of midfoot tread members, the tread width of each of the plurality of ball tread members being less than the tread width of each of the plurality of metatarsal tread members, the tread width of each of the plurality of ball tread members being less than the tread width of each of the plurality of toe tread members.

29. A shoe comprising:

a sole; and an upper secured to the sole;

the sole extending in a longitudinal direction from a sole heel end to a sole toe end and extending transversely from a sole lateral edge to a sole medial edge, the sole including a heel region, a midfoot region, a metatarsal region, a ball region and a toe region, the heel region extending longitudinally forward from the sole heel end to the midfoot region, the midfoot region extending longitudinally forward from the heel region to the metatarsal region, the metatarsal region extending longitudinally forward from the midfoot region to the ball region, the ball region extending longitudinally forward from the metatarsal region to the toe region, and the toe region extending longitudinally forward from the ball region to the sole toe end, the sole having a plurality of tread members and a plurality of grooves, each of the plurality of tread members extending transversely between the sole lateral edge and the sole medial edge, each of the plurality of grooves extending transversely between the sole lateral edge and the sole medial edge, each of the plurality of grooves includes a plurality of upwardly projecting recesses, each of the upwardly projecting recesses having a recess depth, each of at least most of the plurality of grooves being between an adjacent pair of the plurality of tread members and having a groove width constituting a distance in the longitudinal direction from one of the tread members of the adjacent pair of tread members to the other of the tread members of the adjacent pair of tread members, each of the plurality of grooves having a groove depth, each of at least most of the plurality of tread members being between an adjacent pair of the plurality of grooves and having a tread width constituting a distance in the longitudinal direction from one of the grooves of the adjacent pair of grooves to the other of the grooves of the adjacent pair of grooves, the plurality of grooves comprising a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region, the plurality of tread members comprising a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region, the recess depth of each of the plurality of recesses in each of the plurality of heel grooves being greater than the recess depth of each of the plurality of recesses in each of the plurality of midfoot grooves, the recess depth of each of the plurality of recesses in each of the plurality of metatarsal grooves being greater than the recess depth of each of the plurality of recesses in each of the plurality of midfoot grooves, the recess depth of each of the plurality of recesses in each of the plurality of ball grooves being greater than the recess depth of each of the plurality of recesses in each of the plurality of metatarsal grooves, the recess depth of each of the plurality of recesses in each of the plurality of ball grooves being greater than the recess depth of each of the plurality of recesses in each of the plurality of toe grooves.

30. A shoe comprising:

a sole; and an upper secured to the sole;

the sole extending in a longitudinal direction from a sole heel end to a sole toe end and extending transversely from a sole lateral edge to a sole medial edge, the sole including a heel region, a midfoot region, a metatarsal region, a ball region and a toe region, the heel region extending longitudinally forward from the sole heel end to the midfoot region, the midfoot region extending longitudinally forward from the heel region to the metatarsal region, the metatarsal region extending longitudinally forward from the midfoot region to the ball region, the ball region extending longitudinally forward from the metatarsal region to the toe region, and the toe region extending longitudinally forward from the ball region to the sole toe end, the sole having a plurality of tread members and a plurality of grooves, each of the plurality of tread members extending transversely between the sole lateral edge and the sole medial edge, each of the plurality of grooves extending transversely between the sole lateral edge and the sole medial edge, each of the plurality of grooves includes a plurality of upwardly projecting recesses, each of the upwardly projecting recesses having a recess depth, each of at least most of the plurality of grooves being between an adjacent pair of the plurality of tread members and having a groove width constituting a distance in the longitudinal direction from one of the tread members of the adjacent pair of tread members to the other of the tread members of the adjacent pair of tread members, each of the plurality of grooves having a groove depth, each of at least most of the plurality of tread members being between an adjacent pair of the plurality of grooves and having a tread width constituting a distance in the longitudinal direction from one of the grooves of the adjacent pair of grooves to the other of the grooves of the adjacent pair of grooves, the plurality of grooves comprising a plurality of heel grooves in the sole heel region, a plurality of midfoot grooves in the sole midfoot region, a plurality of metatarsal grooves in the sole metatarsal region, a plurality of ball grooves in the sole ball region, and a plurality of toe grooves in the sole toe region, the plurality of tread members comprising a plurality of heel tread members in the sole heel region, a plurality of midfoot tread members in the sole midfoot region, a plurality of metatarsal tread members in the sole metatarsal region, a plurality of ball tread members in the sole ball region, and a plurality of toe tread members in the sole toe region, each of the plurality of tread members extending transversely from the sole lateral edge to the sole medial edge in a zigzag pattern;

each of the plurality of grooves extending transversely from the sole lateral edge to the sole medial edge in a zigzag pattern.

31. A shoe as set forth in claim 30 wherein the sole comprises a closed-cell foam member, each of the plurality of tread members being in the closed-cell foam member, each of the plurality of grooves being in the closed-cell foam member.

* * * * *